US007655328B2

(12) United States Patent
Maeda et al.

(10) Patent No.: US 7,655,328 B2
(45) Date of Patent: Feb. 2, 2010

(54) CONDUCTIVE, PLASMA-RESISTANT MEMBER

(75) Inventors: Takao Maeda, Tokyo (JP); Yuuichi Makino, Tokyo (JP); Hajime Nakano, Tokyo (JP); Ichiro Uehara, Tokyo (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 29 days.

(21) Appl. No.: 11/785,682

(22) Filed: Apr. 19, 2007

(65) Prior Publication Data

US 2007/0248832 A1 Oct. 25, 2007

(30) Foreign Application Priority Data

Apr. 20, 2006 (JP) ..... 2006-116952

(51) Int. Cl.
*B32B 9/00* (2006.01)

(52) U.S. Cl. ..... 428/701; 428/702; 428/469

(58) Field of Classification Search ..... None
See application file for complete search history.

(56) References Cited

U.S. PATENT DOCUMENTS 3,847,650 A * 11/1974 Gregory et al. ..... 427/250
6,783,863 B2 8/2004 Harada et al.
2005/0147852 A1 7/2005 Harada et al.
2005/0199183 A1 9/2005 Arai et al.

FOREIGN PATENT DOCUMENTS

| | | |
|---|---|---|
| DE | 1 521 117 | 12/1969 |
| EP | 1 156 130 A1 | 11/2001 |
| JP | 2001-164354 A | 6/2001 |
| JP | 2002-241971 A | 8/2002 |

* cited by examiner

*Primary Examiner*—Timothy M Speer
(74) *Attorney, Agent, or Firm*—Birch, Stewart, Kolasch & Birch, LLP

(57) ABSTRACT

An electrically conductive, plasma-resistant member adapted for exposure to a halogen-based gas plasma atmosphere includes a substrate having formed on at least part of a region thereof to be exposed to the plasma a thermal spray coating composed of yttrium metal or yttrium metal in admixture with yttrium oxide and/or yttrium fluoride so as to confer electrical conductivity. Because the member is conductive and has an improved erosion resistance to halogen-based corrosive gases or plasmas thereof, particle contamination due to plasma etching when used in semiconductor manufacturing equipment or flat panel display manufacturing equipment can be suppressed.

3 Claims, No Drawings

CONDUCTIVE, PLASMA-RESISTANT MEMBER

CROSS-REFERENCE TO RELATED APPLICATION

This non-provisional application claims priority under 35 U.S.C. §119(a) on Patent Application No. 2006-116952 filed in Japan on Apr. 20, 2006, the entire contents of which are hereby incorporated by reference.

BACKGROUND OF THE INVENTION

1. Field of the Invention

The present invention relates to an electrically conductive, plasma-resistant member that is resistant to erosion by halogen-based plasmas and has a coating endowed with electrical conductivity, wherein at least part of the member to be exposed to plasma has formed thereon by thermal spraying a coating made of yttrium metal, a mixture of yttrium metal and yttrium oxide, a mixture of yttrium metal and yttrium fluoride, or a mixture of yttrium metal, yttrium oxide and yttrium fluoride. Such members may be suitably used as, for example, components or parts exposed to a plasma in semiconductor manufacturing equipment or in flat panel display manufacturing equipment (e.g., equipment for manufacturing liquid crystal displays, organic electroluminescent devices or inorganic electroluminescent devices).

2. Prior Art

To prevent contamination of the workpieces by impurities, semiconductor manufacturing equipment and flat panel display manufacturing equipment (e.g., equipment for manufacturing liquid crystal displays, organic electroluminescent devices and inorganic electroluminescent devices) which are used in a halogen-based plasma environment are expected to be made of materials having a high purity and low plasma erosion.

Equipment such as gate etchers, dielectric film etchers, resist ashers, sputtering systems, and chemical vapor deposition (CVD) systems are used in semiconductor manufacturing operations. Equipment such as etchers for fabricating thin-film transistors are used in liquid crystal display manufacturing operations. These manufacturing systems are being equipped with plasma generators to enable fabrication to smaller feature sizes and thus achieve higher levels of circuit integration.

In the course of these manufacturing operations, halogen-based corrosive gases such as fluorine-based gases and chlorine-based gases are employed in the above equipment on account of their high reactivity.

Examples of fluorine-based gases include $SF_6$, $CF_4$, $CHF_3$, $ClF_3$, HF, and $NF_3$. Examples of chlorine-based gases include $Cl_2$, $BCl_3$, HCl, $CCl_4$ and $SiCl_4$. These gases are converted to a plasma by introducing microwaves or radio-frequency waves to an atmosphere containing the gas. Members of a piece of equipment that are exposed to such halogen-based gases or their plasmas are required to have a high resistance to erosion.

To address such a requirement, coatings of ceramic, such as quartz, alumina, silicon nitride or aluminum nitride and anodized aluminum coatings have hitherto been used as materials for imparting members with erosion resistance to halogen-based gases or plasmas thereof. Recently, use is also being made of members composed of stainless steel or Alumite-treated aluminum whose plasma resistance has been further enhanced by thermally spraying yttrium oxide thereon (JP-A 2001-164354).

However, the surface of such components whose plasma resistance is to be improved is often an electrical insulator. Efforts to improve the plasma resistance result in the interior of the plasma chamber becoming coated with the insulator. In such a plasma environment, at higher voltages, abnormal electrical discharges sometimes arise, damaging the insulating film on the equipment and causing particles to form, or the plasma-resistant coating peels, exposing the underlying surface that lacks plasma resistance and leading to an abrupt increase in particles. The particles that have broken off in this way off deposit in such places as the semiconductor wafer or the vicinity of the bottom electrode, adversely affecting the etching accuracy and thus compromising the performance and reliability of the semiconductor.

Although the purpose for improvement differs from that in the present invention, JP-A 2002-241971 discloses a plasma-resistant member in which the surface region to be exposed to a plasma in the presence of a corrosive gas is formed of a layer of a periodic table group IIIA metal. The film thickness is described therein as about 50 to 200 μm. However, the examples provided in that published document describe film deposition by a sputtering process. Application of such a process to actual members would be extremely difficult, both economically and technically. Hence, such an approach lacks sufficient practical utility.

SUMMARY OF THE INVENTION

It is therefore an object of the present invention to provide an electrically conductive, plasma-resistant member having erosion resistance for use in, for example, semiconductor manufacturing equipment and flat panel display manufacturing equipment, which member, by being endowed both with a sufficient resistance to halogen-based corrosive gases or their plasmas and with electrical conductivity, reduces abnormal discharges at high voltage, ultimately suppressing particle generation and minimizing the content of iron as an impurity.

The inventors have found that members which have been thermally sprayed with yttrium metal, preferably yttrium metal containing not more than 500 ppm of iron based on the total amount of yttrium element, on at least a portion of a surface layer on a side to be exposed to a halogen-based plasma, and members having a layer on which has been formed a thermal spray coating composed of a mixture of yttrium metal and yttrium oxide, a mixture of yttrium metal and yttrium fluoride, or a mixture of yttrium metal, yttrium oxide and yttrium fluoride, suppress damage due to plasma erosion even when exposed to a halogen-based plasma, and are thus useful in, for example, semiconductor manufacturing equipment and flat panel display manufacturing equipment capable of reducing particle adhesion on semiconductor wafers.

The reason appears to be that, because portions having electrical conductivity are formed in at least some of the areas to be exposed to the plasma, abnormal discharges are reduced and suitable leakage of the plasma is allowed to arise, thus holding down particle generation. Moreover, because the member is in an environment where erosion readily proceeds owing to the use of a halogen gas plasma, it is desirable for the iron concentration within the coating on the conductive portions thereof to be not more than 500 ppm with respect to the yttrium. The inventors have also discovered that when yttrium oxide or yttrium fluoride is mixed with the yttrium metal, the electrical conductivity decreases. They have also learned that the electrical conductivity, expressed as the resistivity, is preferably not more than 5,000 Ω·cm.

Accordingly, the invention provides an electrically conductive, plasma-resistant member adapted for exposure to a halogen-based gas plasma atmosphere. The member includes a substrate having formed on at least part of a region thereof to be exposed to the plasma a thermal spray coating of yttrium metal or yttrium metal in admixture with yttrium oxide and/or yttrium fluoride so as to confer electrical conductivity.

In a preferred aspect of the invention, the thermal spray coating has an iron concentration with respect to the total amount of yttrium element of at most 500 ppm.

In another preferred aspect of the invention, the thermal spray coating has a resistivity of at most 5,000 Ω·cm.

The conductive, plasma-resistant member of the invention has an improved resistance to erosion by halogen-based corrosive gases or plasmas thereof, and thus is able to suppress particle contamination due to plasma etching when used in, for example, semiconductor manufacturing equipment or flat panel display manufacturing equipment.

Moreover, up until now, the members used within a plasma chamber, owing to the great important placed on their resistance to the plasmas of halogen-based gases, have often been coated on the surface with an electrical insulator. As a result, because electrical charges which have accumulated within the plasma have no proper route of escape, such charges have only been able to escape by causing an abnormal discharge in a portion of the chamber having a weak dielectric withstanding voltage. Such abnormal discharges sometimes even attain an arc state, destroying the coating. If a plasma-resistant member endowed with electrical conductivity is present, the accumulated electrical charge will preferentially discharge there. Hence, discharge will occur before a high voltage is reached, thus preventing an abnormal discharge from arising and in turn making it possible to reduce particle generation due to coating damage.

DETAILED DESCRIPTION OF THE INVENTION

The electrically conductive, plasma-resistant member of the invention is an erosion-resistant member having formed, on at least part of a side thereof to be exposed to a halogen-based gas plasma environment, a thermal spray coating of yttrium metal, a mixture of yttrium metal and yttrium oxide, a mixture of yttrium metal and yttrium fluoride, or a mixture of yttrium metal, yttrium oxide and yttrium fluoride.

It is preferable here that the thermal spray powder used to form the thermal spray coating be one having an iron content that is low so as minimize the iron content within the thermal spray coating. The trend in recent years has been to manufacture semiconductor devices and the like to smaller feature sizes and larger diameters. In so-called dry processes, particularly etching processes, use is coming to be made of low-pressure, high-density plasmas. When such low-pressure, high-density plasmas are used, the effect on plasma-resistant members is greater than prior-art etching conditions, leading to major problems, such as erosion by the plasma, member ingredient contamination arising from such erosion, and contamination arising from reaction products due to surface impurities. With regard to iron in particular, when iron is present in a plasma-resistant material, the etching rate rises, raising the concern that the chamber interior and the wafer being treated may be subject to contamination. Accordingly, it is desirable to minimize the iron content within the plasma-resistant material.

The concentration of iron in the conductive plasma-resistant coating should be held to preferably not more than 500 ppm, based on the total amount of yttrium element. The total amount of yttrium element means the following. When the thermal spray coating is composed of only yttrium metal, the total amount of yttrium element is the amount of the yttrium metal. When the thermal spray coating is composed of yttrium metal in admixture with yttrium oxide and/or yttrium fluoride, the total amount of yttrium element is the sum of the amount of the yttrium metal and the amount of yttrium element in the yttrium oxide and/or yttrium fluoride. To this end, the concentration of iron impurities in the thermal spray powder must be held to not more than 500 ppm. The thermal spray powder can generally be prepared by an atomizing process such as gas atomization, disc atomization or rotating electrode atomization.

To hold the iron concentration to 500 ppm or below, the incorporation of iron in these atomizing processes must be minimized. However, there is a factor that tends to raise the iron concentration above this level; namely, the inadvertent incorporation of iron powder when yttrium oxide is converted to yttrium fluoride at the start of yttrium metal preparation. It is preferable that deironing treatment is conducted to yttrium oxide and yttrium fluoride during their preparation. For example, deironing in which the iron powder that has been incorporated into the yttrium fluoride is attracted with a magnet may be carried out. The concentration of iron within the thermal spray powder is held in this way to 500 ppm or below with respect to the total amount of yttrium element.

A precursor powder for thermal spraying having a controlled conductivity is thus prepared by mixing yttrium metal powder having a reduced iron concentration with an yttrium oxide thermal spraying precursor powder having a reduced iron concentration, with an yttrium fluoride thermal spraying precursor powder having a reduced iron concentration, or with both yttrium oxide and yttrium fluoride each having a reduced iron concentration.

By thermally spraying these precursor powders, electrically conductive thermal spray coatings having an iron impurity concentration of 500 ppm or below can be obtained.

To achieve electrical conductivity, it is desirable for the thermal spray coating to be prepared from a thermal spray powder containing preferably at least 3 wt % and up to 100 wt % of metallic yttrium, with the remainder being atomized yttrium oxide or yttrium fluoride. To measure the yttrium metal concentration, given that the thermal spray powder is a mixture of yttrium metal with yttrium oxide or yttrium fluoride, first the oxygen concentration or fluorine concentration in the material is measured and the equivalent as $Y_2O_3$ or $YF_3$ is determined. The remaining yttrium is then treated as a metallic component.

It is preferable for the substrate on which the above thermal spray coating (yttrium metal thermal spray coating, or a mixed thermal spray coating of yttrium metal with yttrium oxide and/or yttrium fluoride) is formed to be at least one selected from among titanium, titanium alloys, aluminum, aluminum alloys, stainless steel, quartz glass, alumina, aluminum nitride, carbon and silicon nitride.

When a thermal spray coating is formed as described above on the surface portion of these substrates to be exposed to plasma, a metal layer (nickel, aluminum, molybdenum, hafnium, vanadium, niobium, tantalum, tungsten, titanium, cobalt or an alloy thereof) or a ceramic layer (alumina, yttria, zirconia) may first be formed on the substrate. Even in such a case, an outermost layer of yttrium metal, a mixture of yttrium metal and yttrium oxide, a mixture of yttrium metal and yttrium fluoride, or a mixture of yttrium metal with yttrium oxide and yttrium fluoride is formed by thermal spraying, thereby providing the halogen plasma-resistant thermal spray coating having electrical conductivity on at least part of the substrate surface which is a characteristic feature of the invention.

It is desirable for the thermal spray coating to have an electrical conductivity greater than 0 Ω·cm but not more than 5,000 Ω·cm, and preferably in a range of from $10^{-4}$ to $10^{3}$ Ω·cm. By conferring the thermal spray coating with such an electrical conductivity, abnormal discharge within the chamber does not occur, making it possible to prevent arc damage.

In particular, even if the substrate is a dielectric material or the substrate is electrically conductive but an intermediate layer made of a dielectric material has been formed thereon, the characteristic features of the invention can be fully achieved by suitable modification, such as forming holes in the substrate and embedding conductive pins or the like therein, then depositing as the outermost layer a conductive, halogen plasma-resistant thermal spray coating, or making the thermal spray coating continuous from the front side to the back side of the substrate and connecting an electrically conductive portion to a ground or the like.

Thermal spraying may be carried out by any thermal spraying process cited in Yosha Handobukku [Thermal Spraying Handbook], such as gas thermal spraying and plasma spraying. In recent years, there has existed a related process known as aerosol deposition which, although not thermal spraying per se, may be used as the spraying process for the purposes of the invention. With regard to the thermal spraying conditions, a known method such as atmospheric-pressure thermal spraying, controlled-atmosphere thermal spraying or low-pressure thermal spraying may be used. The precursor powder is loaded into the thermal spraying apparatus and a coating is deposited to the desired thickness while controlling the distance between the nozzle or thermal spraying gun and the substrate, the velocity of movement between the nozzle or thermal spraying gun and the substrate, the type of gas, the gas flow rate, and the powder feed rate.

It is desirable for the thermal spray coating which has been conferred with electrical conductivity to have a thickness of at least 1 μm. The thickness may be set within a range of from 1 to 1,000 μm. However, because corrosion is not entirely absent, to increase the life of the coated member, it is generally preferable for the coating thickness to be from 10 to 500 μm, and especially from 30 to 300 μm.

When yttrium metal has been plasma sprayed under atmospheric conditions, yttrium nitride sometimes forms on the surface of the plasma sprayed coating. Because yttrium nitride is hydrolyzed by atmospheric moisture and the like, if surface nitridation has occurred, the yttrium nitride should be promptly removed.

The conductive, plasma-resistant member of the invention obtained in the foregoing manner has a portion which is electrically conductive and which both enhances the erosion resistance to halogen-based plasmas and also confers electrical conductivity to the interior of the plasma chamber. As a result, particle formation due to abnormal discharge is suppressed and an even more stable plasma is generated, enabling improvements to be made in the wafer etching performance and the formation of stable coatings by plasma CVD.

EXAMPLES

Examples of the invention and Comparative Examples are given below by way of illustration and not by way of limitation.

Example 1

A thermal spray powder was prepared by weighing out 15 g of disc-atomized metallic yttrium powder having an iron content of 352 ppm and 485 g of yttrium oxide powder, and mixing the powders for 1 hour in a V-type mixer. Next, an aluminum alloy substrate measuring 100×100 ×5 mm was degreased with acetone, then roughened on one side by blasting with alumina grit. The thermal spray powder was then sprayed onto the substrate with a plasma sprayer using argon and hydrogen as the plasma gases at an output of 40 kW, a spray distance of 120 mm and a powder feed rate of 20 g/min so as form a coating having a thickness of about 200 μm, thereby giving a test specimen.

Another test specimen was formed in the same manner as above except that an alumina substrate was used instead of the aluminum alloy substrate. The thermal spray coating deposited on the alumina substrate was then dissolved in hydrochloric acid and the resulting solution was analyzed by inductively coupled plasma (ICP) emission spectrometry, whereupon the coating was found to have an iron concentration, based on the total yttrium element, of 40 ppm.

Example 2

A thermal spray powder was prepared by weighing out 25 g of gas-atomized metallic yttrium powder having an iron content of 120 ppm and 475 g of yttrium oxide powder, and mixing the powders for 1 hour in a V-type mixer. Next, an aluminum alloy substrate measuring 100×100×5 mm was degreased with acetone, following which the thermal spray powder was sprayed onto the substrate with a plasma sprayer using argon and hydrogen as the plasma gases at an output of 40 kW, a spray distance of 120 mm and a powder feed rate of 20 g/min so as form a coating having a thickness of about 200 μm, thereby giving a test specimen.

Another test specimen was formed in the same manner as above except that an alumina substrate was used instead of, the aluminum alloy substrate. The thermal spray coating deposited on the alumina substrate was then dissolved in hydrochloric acid and the resulting solution was analyzed by ICP emission spectrometry, whereupon the coating was found to have an iron concentration, based on the total yttrium element, of 15 ppm.

Example 3

A thermal spray powder was prepared by weighing out 50 g of rotating electrode-atomized metallic yttrium powder having an iron content of 80 ppm and 450 g of yttrium oxide powder, and mixing the powders for 1 hour in a V-type mixer. Next, an aluminum alloy substrate measuring 100×100×5 mm was degreased with acetone, following which the thermal spray powder was sprayed onto the substrate with a plasma sprayer using argon and hydrogen as the plasma gases at an output of 40 kW, a spray distance of 120 mm and a powder feed rate of 20 g/min so as form a coating having a thickness of about 200 μm, thereby giving a test specimen.

Another test specimen was formed in the same manner as above except that an alumina substrate was used instead of the aluminum alloy substrate. The thermal spray coating deposited on the alumina substrate was then dissolved in hydrochloric acid and the resulting solution was analyzed by ICP emission spectrometry, whereupon the coating was found to have an iron concentration, based on the total yttrium element, of 17 ppm.

Example 4

A thermal spray powder was prepared by weighing out 250 g of gas-atomized metallic yttrium powder having an iron content of 120 ppm and 250 g of yttrium oxide powder, and mixing the powders for 1 hour in a V-type mixer. Next, a stainless steel substrate measuring 100×100×5 mm was degreased with acetone, following which the thermal spray powder was sprayed onto the substrate with an atmospheric pressure plasma sprayer using argon and hydrogen as the plasma gases at an output of 40 kW, a spray distance of 120 mm and a powder feed rate of 20 g/min so as form a coating having a thickness of about 200 μm, thereby giving a test specimen.

Another test specimen was formed in the same manner as above except that an alumina substrate was used instead of the stainless steel substrate. The plasma spray coating deposited on the alumina substrate was then dissolved in hydrochloric acid and the resulting solution was analyzed by ICP emission spectrometry, whereupon the coating was found to have an iron concentration, based on the total yttrium element, of 72 ppm.

It is apparent from the results obtained in the above examples of the invention that the iron concentration of the plasma spray coating is most greatly affected by the iron content within the metallic yttrium powder, and substantially does not increase as a result of thermal spraying per se.

Example 5

A thermal spray powder was prepared by weighing out 15 g of gas-atomized metallic yttrium powder having an iron content of 120 ppm and 485 g of yttrium fluoride powder, and mixing the powders for 1 hour in a V-type mixer. Next, an aluminum alloy substrate measuring 100×100×5 mm was degreased with acetone, following which the thermal spray powder was sprayed onto the substrate with a plasma sprayer using argon and hydrogen as the plasma gases at an output of 40 kW, a spray distance of 120 mm and a powder feed rate of 20 g/min so as form a coating having a thickness of about 200 μm, thereby giving a test specimen.

Another test specimen was formed in the same manner as above except that an alumina substrate was used instead of the aluminum alloy substrate. The thermal spray coating deposited on the alumina substrate was then dissolved in hydrochloric acid and the resulting solution was analyzed by ICP emission spectrometry, whereupon the coating was found to have an iron concentration, based on the total yttrium element, of 13 ppm.

Example 6

A thermal spray powder was prepared by weighing out 25 g of gas-atomized metallic yttrium powder having an iron content of 120 ppm and 475 g of yttrium fluoride powder, and mixing the powders for 1 hour in a V-type mixer. Next, an aluminum alloy substrate measuring 100×100×5 mm was degreased with acetone, following which the thermal spray powder was sprayed onto the substrate with a plasma sprayer using argon and hydrogen as the plasma gases at an output of 40 kW, a spray distance of 120 mm and a powder feed rate of 20 g/min so as form a coating having a thickness of about 200 μm, thereby giving a test specimen.

Another test specimen was formed in the same manner as above except that an alumina substrate was used instead of the aluminum alloy substrate. The thermal spray coating deposited on the alumina substrate was then dissolved in hydrochloric acid and the resulting solution was analyzed by ICP emission spectrometry, whereupon the coating was found to have an iron concentration, based on the total yttrium element, of 18 ppm.

Example 7

A thermal spray powder was prepared by weighing out 50 g of gas-atomized metallic yttrium powder having an iron content of 120 ppm and 450 g of yttrium fluoride powder, and mixing the powders for 1 hour in a V-type mixer. Next, an aluminum alloy substrate measuring 100×100×5 mm was degreased with acetone, following which the thermal spray powder was sprayed onto the substrate with a plasma sprayer using argon and hydrogen as the plasma gases at an output of 40 kW, a spray distance of 120 mm and a powder feed rate of 20 g/min so as form a coating having a thickness of about 200 μm, thereby giving a test specimen.

Another test specimen was formed in the same manner as above except that an alumina substrate was used instead of the aluminum alloy substrate. The thermal spray coating deposited on the alumina substrate was then dissolved in hydrochloric acid and the resulting solution was analyzed by ICP emission spectrometry, whereupon the coating was found to have an iron concentration, based on the total yttrium element, of 22 ppm.

Example 8

A thermal spray powder was prepared by weighing out 250 g of gas-atomized metallic yttrium powder having an iron content of 120 ppm and 250 g of yttrium fluoride powder, and mixing the powders for 1 hour in a V-type mixer. Next, an aluminum alloy substrate measuring 100×100×5 mm was degreased with acetone, following which the thermal spray powder was sprayed onto the substrate with a plasma sprayer using argon and hydrogen as the plasma gases at an output of 40 kW, a spray distance of 120 mm and a powder feed rate of 20 g/min so as form a coating having a thickness of about 200 μm, thereby giving a test specimen.

Another test specimen was formed in the same manner as above except that an alumina substrate was used instead of the aluminum alloy substrate. The thermal spray coating deposited on the alumina substrate was then dissolved in hydrochloric acid and the resulting solution was analyzed by ICP emission spectrometry, whereupon the coating was found to have an iron concentration, based on the total yttrium element, of 65 ppm.

Example 9

An aluminum alloy substrate measuring 100×100×5 mm was degreased with acetone, following which a gas-atomized metallic yttrium powder having an iron content of 120 ppm was sprayed onto the substrate with a plasma sprayer using argon and hydrogen as the plasma gases at an output of 40 kW, a spray distance of 120 mm and a powder feed rate of 20 g/min so as form a coating having a thickness of about 200 μm, thereby giving a test specimen.

Another test specimen was formed in the same manner as above except that an alumina substrate was used instead of the aluminum alloy substrate. The thermal spray coating deposited on the alumina substrate was then dissolved in hydrochloric acid and the resulting solution was analyzed by ICP emission spectrometry, whereupon the coating was found to have an iron concentration, based on the total yttrium element, of 121 ppm.

Example 10

A thermal spray powder was prepared by weighing out both 150 g of gas-atomized metallic yttrium powder having an iron content of 120 ppm and 50 g of yttrium oxide powder, and mixing the powders for 1 hour in a V-type mixer. Next, an aluminum alloy substrate measuring 100×100×5 mm was degreased with acetone, following which the thermal spray powder was sprayed onto the substrate with a plasma sprayer using argon and hydrogen as the plasma gases at an output of 40 kW, a spray distance of 120 mm and a powder feed rate of 20 g/min so as form a coating having a thickness of about 200 μm, thereby giving a test specimen.

Another test specimen was formed in the same manner as above except that an alumina substrate was used instead of the aluminum alloy substrate. The thermal spray coating deposited on the alumina substrate was then dissolved in hydrochloric acid and the resulting solution was analyzed by ICP emission spectrometry, whereupon the coating was found to have an iron concentration, based on the total yttrium element, of 92 ppm.

Example 11

A thermal spray powder was prepared by weighing out 180 g of gas-atomized metallic yttrium powder having an iron content of 120 ppm and 20 g of yttrium fluoride powder, and mixing the powders for 1 hour in a V-type mixer. Next, an aluminum alloy substrate measuring 100×100×5 mm was degreased with acetone, following which the thermal spray powder was sprayed onto the substrate with a plasma sprayer using argon and hydrogen as the plasma gases at an output of 40 kW, a spray distance of 120 mm and a powder feed rate of 20 g/min so as form a coating having a thickness of about 200 μm, thereby giving a test specimen.

Another test specimen was formed in the same manner as above except that an alumina substrate was used instead of the aluminum alloy substrate. The thermal spray coating deposited on the alumina substrate was then dissolved in hydrochloric acid and the resulting solution was analyzed by ICP emission spectrometry, whereupon the coating was found to have an iron concentration, based on the total yttrium element, of 110 ppm.

Example 12

A thermal spray powder was prepared by weighing out 160 g of gas-atomized metallic yttrium powder having an iron content of 120 ppm, 20 g of yttrium oxide and 20 g of yttrium fluoride powder, and mixing the powders for 1 hour in a V-type mixer. Next, an aluminum alloy substrate measuring 100×100×5 mm was degreased with acetone, following which the thermal spray powder was sprayed onto the substrate with a plasma sprayer using argon and hydrogen as the plasma gases at an output of 40 kW, a spray distance of 120 mm and a powder feed rate of 20 g/min so as form a coating having a thickness of about 200 μm, thereby giving a test specimen.

Another test specimen was formed in the same manner as above except that an alumina substrate was used instead of the aluminum alloy substrate. The thermal spray coating deposited on the alumina substrate was then dissolved in hydrochloric acid and the resulting solution was analyzed by ICP emission spectrometry, whereupon the coating was found to have an iron concentration, based on the total yttrium element, of 100 ppm.

Comparative Example 1

An aluminum alloy substrate measuring 100×100×5 mm was degreased with acetone, following which yttrium oxide powder was sprayed onto the substrate with a plasma sprayer using argon and hydrogen as the plasma gases at an output of 40 kW, a spray distance of 120 mm and a powder feed rate of 20 g/min so as form a coating having a thickness of about 200 μm, thereby giving a test specimen.

Comparative Example 2

An aluminum alloy substrate measuring 100×100×5 mm was degreased with acetone, following which alumina powder was sprayed onto the substrate with a plasma sprayer using argon and hydrogen as the plasma gases at an output of 40 kW, a spray distance of 120 mm and a powder feed rate of 20 g/min so as form a coating having a thickness of about 200 μm, thereby giving a test specimen.

Comparative Example 3

A test specimen obtained by effecting anodic oxidation treatment to the surface of an aluminum alloy substrate measuring 100×100×5 mm was used.

Evaluation of Resistivity

The plasma-sprayed surfaces of the test specimens were polished, and the resistivity of the plasma spray coating in each example of the invention and each comparative example (in Comparative Example 3, the anodic oxidation coating) was measured with a resistivity meter (Loresta HP, manufactured by Mitsubishi Chemical Corporation (now Dia Instruments)). The results obtained are shown in Table 1.

TABLE 1

| No. | Mixing ratio of components in plasma spray powder (weight ratio) | (Ω · cm) |
|---|---|---|
| Example 1 | (metallic yttrium:yttrium oxide) = 3:97 | $2 \times 10^{+1}$ |
| Example 2 | (metallic yttrium:yttrium oxide) = 5:95 | $<1 \times 10^{-2}$ |
| Example 3 | (metallic yttrium:yttrium oxide) = 10:90 | $<1 \times 10^{-2}$ |
| Example 4 | (metallic yttrium:yttrium oxide) = 50:50 | $<1 \times 10^{-2}$ |
| Example 5 | (metallic yttrium:yttrium fluoride) = 3:97 | $5 \times 10^{+3}$ |
| Example 6 | (metallic yttrium:yttrium fluoride) = 5:95 | $<1 \times 10^{-2}$ |
| Example 7 | (metallic yttrium:yttrium fluoride) = 10:90 | $<1 \times 10^{-2}$ |
| Example 8 | (metallic yttrium:yttrium fluoride) = 50:50 | $<1 \times 10^{-2}$ |
| Example 9 | (metallic yttrium) = 100 | $<1 \times 10^{-2}$ |
| Example 10 | (metallic yttrium:yttrium oxide) = 75:25 | $<1 \times 10^{-2}$ |
| Example 11 | (metallic yttrium:yttrium fluoride) = 90:10 | $<1 \times 10^{-2}$ |
| Example 12 | (metallic yttrium:yttrium oxide:yttrium fluoride) = 80:10:10 | $<1 \times 10^{-2}$ |
| Comparative Example 1 | (yttrium oxide) = 100 | $3 \times 10^{+15}$ |
| Comparative Example 2 | (aluminum oxide) = 100 | $3 \times 10^{+15}$ |
| Comparative Example 3 | (anodic oxidation coating) | $2 \times 10^{+15}$ |

As is apparent from the resistivity results in Table 1, the thermal spray coatings of yttrium oxide and aluminum oxide and the anodic oxidation coating were all insulators. It was confirmed, however, that electrical conductivity is conferred by including metallic yttrium in the plasma spray powder.

Evaluation of Resistance to Erosion by Plasma

In each example, the test piece was cut to dimensions of 20×20×5, then surface polished to a roughness $R_a$ of 0.5 or below. The surface was then masked with polyimide tape so as to leave a 10 mm square area exposed at the center, and an irradiation test was carried out for a given length of time using a reactive ion etching (RIE) system in a mixed gas plasma of $CF_4$ and $O_2$. The erosion depth was determined by measuring the height of the step between the masked and unmasked areas using a Dektak 3ST stylus surface profiler The plasma exposure conditions were as follows: output, 0.55 W; gas, $CF_4$+$O_2$ (20%); gas flow rate, 50 sccm; pressure, 7.9 to 6.0 Pa. The results obtained are shown in Table 2.

TABLE 2

| No. | Mixing ratio of components in plasma spray powder (weight ratio) | Erosion rate (nm/min) |
|---|---|---|
| Example 1 | (metallic yttrium:yttrium oxide) = 3:97 | 2.7 |
| Example 2 | (metallic yttrium:yttrium oxide) = 5:95 | 2.7 |
| Example 3 | (metallic yttrium:yttrium oxide) = 10:90 | 2.7 |
| Example 4 | (metallic yttrium:yttrium oxide) = 50:50 | 2.8 |
| Example 5 | (metallic yttrium:yttrium fluoride) = 3:97 | 2.5 |
| Example 6 | (metallic yttrium:yttrium fluoride) = 5:95 | 2.3 |
| Example 7 | (metallic yttrium:yttrium fluoride) = 10:90 | 2.5 |
| Example 8 | (metallic yttrium:yttrium fluoride) = 50:50 | 2.2 |
| Example 9 | (metallic yttrium) = 100 | 2.1 |
| Example 10 | (metallic yttrium:yttrium oxide) = 75:25 | 2.2 |
| Example 11 | (metallic yttrium:yttrium fluoride) = 90:10 | 2.3 |
| Example 12 | (metallic yttrium:yttrium oxide:yttrium fluoride) = 80:10:10 | 2.2 |
| Comparative Example 1 | (yttrium oxide) = 100 | 2.5 |
| Comparative Example 2 | (aluminum oxide) = 100 | 12.5 |
| Comparative Example 3 | (anodic oxidation coating) | 14.5 |

From the results in Tables 1 and 2, plasma spray coatings containing metallic yttrium exhibit a good electrical conductivity without a loss of plasma resistance. Because such coatings have conductivity, abnormal discharges do not arise within the chamber and arc damage does not occur. Hence, it was confirmed that a good performance characterized by a suppressed erosion rate is exhibited even with exposure to a halogen-based gas plasma atmosphere.

By using such thermal spray coatings endowed with both plasma resistance and electrical conductivity at the interior of plasma chambers within semiconductor manufacturing equipment and liquid crystal manufacturing equipment, desirable effects such as plasma stabilization and a reduction in abnormal discharges can be expected.

Reference Example

A thermal spray powder was prepared by weighing out 200 g of gas-atomized metallic yttrium powder having an iron content of 120 ppm, 25 g of yttrium oxide powder and 25 g of yttrium fluoride powder, and mixing the powders for 1 hour in a V-type mixer. Next, a stainless steel substrate measuring 100×100×5 mm was degreased with acetone, following which the thermal spray powder was sprayed onto the substrate with an atmospheric-pressure plasma sprayer using argon and hydrogen as the plasma gases at an output of 40 kW, a spray distance of 120 mm and a powder feed rate of 20 g/min so as form a coating having a thickness of about 200 μm, thereby giving a test specimen.

The test specimen was sectioned, and the sectioned specimen was prepared for examination by setting it in epoxy resin and polishing the sectioned plane to be examined. Examination was carried out with a JXA-8600 electron microprobe manufactured by JEOL Ltd. Investigation of the elemental distribution of nitrogen by surface analysis confirmed that nitrogen was distributed over the surface, indicating that the thermal spraying of yttrium metal powder under atmospheric conditions is characterized by surface nitridation.

Japanese Patent Application No. 2006-116952 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. An electrically conductive, plasma-resistant member adapted for exposure to a halogen-based gas plasma atmosphere, comprising:

a substrate having formed on at least part of a region thereof to be exposed to the plasma a thermal spray coating comprising yttrium metal in admixture with yttrium oxide and/or yttrium fluoride so as to confer electrical conductivity.

2. The member of claim 1, wherein the thermal spray coating has an iron concentration with respect to the total amount of yttrium element of at most 500 ppm.

3. The member of claim 1, wherein the thermal spray coating has a resistivity of at most 5,000 Ω·cm.

* * * * *